United States Patent [19]

Tadachi et al.

[11] Patent Number: 4,652,839

[45] Date of Patent: Mar. 24, 1987

[54] WAVEGUIDE-TO-COAXIAL CONVERTER

[75] Inventors: Akio Tadachi; Makoto Sato, both of Soma, Japan

[73] Assignee: Alps Electric Co., Ltd., Japan

[21] Appl. No.: 748,579

[22] Filed: Jun. 25, 1985

[30] Foreign Application Priority Data

Jun. 25, 1984 [JP] Japan ..... 59-94876[U]

[51] Int. Cl.[4] ..... H01P 5/103

[52] U.S. Cl. ..... 333/26; 333/248

[58] Field of Search ..... 333/26, 245, 250, 21, 333/248

[56] References Cited

U.S. PATENT DOCUMENTS 3,737,812 6/1973 Gaudio et al. ..... 333/21 R X 4,458,222 7/1984 Herstein et al. ..... 333/26

OTHER PUBLICATIONS

Matthaei et al., *Microwave Filters, Impedance-Matching Networks and Coupling Structures,* McGraw-Hill, N.Y., 1964, p. 363 cited.

*Primary Examiner*—Paul Gensler

*Attorney, Agent, or Firm*—Guy W. Shoup

[57] ABSTRACT

A waveguide-to-coaxial converter has a dielectric element attached to a ridge provided inside a waveguide. A coaxial line for a converted wave output which is secured to an output side of the ridge is DC insulated by the dielectric element from the waveguide.

3 Claims, 6 Drawing Figures

WAVEGUIDE-TO-COAXIAL CONVERTER

FIELD OF THE INVENTION

The present invention relates to a waveguide-to-coaxial converter employed, for example, in an input section of a receiver for the satellite broadcast.

BACKGROUND OF THE INVENTION

In receiving the satellite broadcast, the waveguide-to-coaxial converter is employed to transmit a radio wave received by a parabolic antenna to a receiving circuit. FIG. 2 illustrates an example of the conventional waveguide-to-coaxial converter. In this drawing, 1 is a waveguide, 2 is a ridge, and 3 is a coaxial line. 4 is an RF amplifier which is composed of a DC-blocking condenser 5, an amplifying transistor 6, such as GaAs-FET, and the like. The ridge 2 is fixed conductingly on an inner wall surface of the waveguide 1 by screws (not shown), for example, to one end of which the coaxial line 3 is secured, the other side end of the coaxial line 3 being led out toward the RF amplifier 4. As shown in FIG. 3, the circuit of the RF amplifier 4 is made up of the condenser 5 and the amplifying transistor 6 both mounted on an insulating board 7*a* such as a ceramic substrate, and strip lines 7 and 8 provided on the board. The point of the coaxial line 3 is connected to the strip line 7. The condenser 5 is employed for insulating the transistor 6 from DC components from the waveguide (1) side because a bias voltage is applied to the transistor 6. For condenser 5 a printed condenser or chip condenser is employed. In operation, the incident radio wave upon the waveguide 1 is converted in wave mode by the ridge 2 provided inside the waveguide 1, the converted wave is taken out from the waveguide 1 through the coaxial line 3 and input into the RF amplifier 4.

In the foregoing conventional waveguide-to-coaxial converter, because the DC-blocking condenser 5 is built in the RF amplifier 4, the strip line 7 is provided at the input section of the RF amplifier 4 to connect the condenser 5 and the coaxial line 3. Further, this strip line 7 is connected to the ridge 2 inside the waveguide 1 through the coaxial line 3. Thus, when an impulse wave containing low frequency components, caused, for example, by lightning, comes in, it is transmitted directly to the strip line 7 and an electric discharge may possibly occur. In addition, because the amplifying transistor 6 may be a GaAsFET which is manufactured for use at very high frequencies, it may be damaged by excess voltage and, thus, there is the problem that the amplifying transistor 6 is destroyed due to the electric discharge caused by lightning if it is provided in the vicinity of the strip line 7.

SUMMARY OF THE INVENTION

The object of the present invention is to overcome such problems as above, and to provide a novel waveguide-to-coaxial converter which is effective to prevent destruction of the amplifying transistor and the like of the RF amplifier (4), that would be caused by lightning, for example.

In order to achieve the foregoing object, in accordance with the present invention, a dielectric element is attached to a ridge provided inside a waveguide, by which element the waveguide and a coaxial line are insulated from each other in the sense of DC components and the coaxial line is led out from the waveguide, for connection to an amplifier.

DETAILED DESCRIPTION OF THE INVENTION

Figure 2:
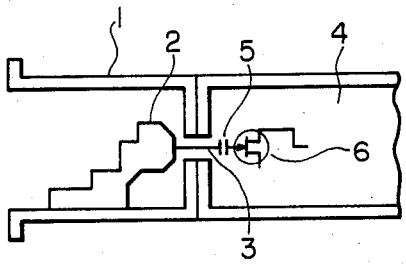
FIG. 2 PRIOR ART
FIG. 2 is a sectional view of the conventional waveguide coaxial converter.
Figure 3:
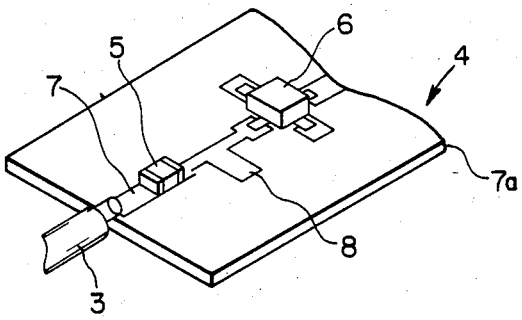
FIG. 3 PRIOR ART
FIG. 3 is a perspective view of the conventional RF amplifier.

The embodiments of the present invention will be described with reference to FIGS. 1, 4 through 6 in which elements corresponding to those shown in FIGS. 2 and 3 bear the same reference numbers.

Figure 1:
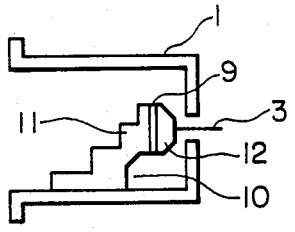
FIG. 1 is a sectional view of an embodiment of a waveguide coaxial converter according to the present invention.
Figure 4:
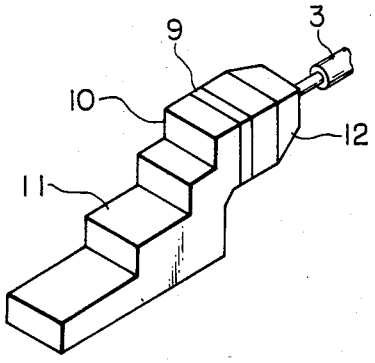
FIG. 4 is a perspective view of a ridge according to the present invention.

In FIGS. 1 and 4, 9 is a dielectric element made of a sheet of Mylar (trade name), Teflon, and the like, and 10 is a ridge. The ridge 10 consists of a front portion 11 and a rear portion 12, between which the dielectric element 9 is secured through thermal press-bonding, for example, so that a capacitance for DC insulation is provided. To one end of the rear portion 12 the coaxial line 3 is secured to provide an output from the waveguide 1, that output being applied to the RF amplifier 4. The capacitance of the dielectric element 9 is previously set to a value necessary for passing a radio wave received from a satellite.

As apparent from the foregoing description, the present waveguide-to-coaxial converter is characterized in that the dielectric element is attached to the ridge 10 provided inside the waveguide 1 and the coaxial line 3 is DC-insulated from the waveguide side. Thus, the condenser 5 of the RF amplifier 4 employed in the prior art can be eliminated, and the circuit can be miniaturized. Further, because the coaxial line 3 is DC-insulated inside the waveguide 1 and the dielectric element 9 does not pass low frequency components of, for example, an impulse wave caused by lightning, an external noise wave such as lightning can not be transmitted directly to the inside of the RF amplifier and the amplifying transistor 6 is prevented from being destroyed.

Figure 5:
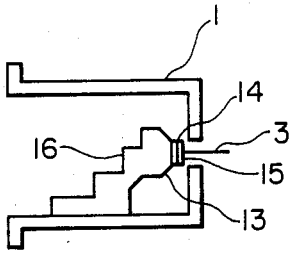
FIGS. 5 and 6 are sectional views of other embodiments according to the present invention.
Figure 6:
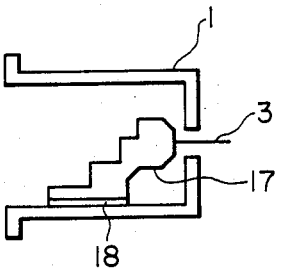

Other embodiments according to the present invention are illustrated in FIGS. 5 and 6. In the converter shown in FIG. 5, a dielectric element 14 is secured between the tip portion 16 of the ridge 13 inside the waveguide 1 and a mounting part 15 of the coaxial line 3. In the converter shown in FIG. 6, a dielectric element 18 is provided between the ground side portion of the ridge 17 inside the waveguide 1 and the waveguide (1) wall. These embodiments can produce also the same effect as that of the first embodiment shown in FIG. 1.

While the preferred embodiments have been described, variations thereto will occur to those skilled in the art within the scope of the present inventive concepts which are delineated by the following claims.

What is claimed is:

1. In a waveguide-to-coaxial converter comprising a waveguide having a ridge section leading into an RF amplifier section, said ridge section having a ridge fixed conductingly by a mounting part thereof to an inner wall surface of the waveguide and having one end of a coaxial line mounted to an output part thereof for providing a converted wave output through the coaxial line to the RF amplifier section, the improvement wherein a dielectric element is interposed in the wave transmission path between said ridge and said coaxial line in order to provide a capacitance for insulating the RF amplifier section from DC components.

2. A waveguide coaxial converter as set forth in claim 1, wherein said dielectric element is interposed between a front portion and a rear portion of the output part of said ridge.

3. A waveguide coaxial converter as set forth in claim 1, wherein said dielectric element is interposed between the output part of said ridge and said coaxial line.

* * * * *